United States Patent [19]

Fan et al.

[11] 4,448,589

[45] May 15, 1984

[54] PYROLYTIC CONVERSION OF CARBONACEOUS SOLIDS TO FUEL GAS IN QUARTZ SAND FLUIDIZED BEDS

[75] Inventors: Liang-tseng Fan; Walter P. Walawender, both of Manhattan, Kans.

[73] Assignee: Kansas State University Research Foundation, Manhattan, Kans.

[21] Appl. No.: 114,698

[22] Filed: Jan. 23, 1980

[51] Int. Cl.[3] ..... C10J 3/54

[52] U.S. Cl. ..... 48/197 R; 48/202; 48/197 A; 48/209

[58] Field of Search ..... 48/197 R, 197 A, 209, 48/202; 201/2.5, 25, 31

[56] References Cited

U.S. PATENT DOCUMENTS

| | | | |
|---|---|---|---|
| 2,582,711 | 1/1952 | Nelson | 48/DIG. 4 |
| 3,853,498 | 12/1974 | Bailie | 48/197 R |
| 3,909,364 | 9/1975 | Singh | 201/2.5 |
| 4,002,438 | 1/1977 | Fleming | 48/209 |
| 4,032,305 | 6/1977 | Squires | 48/206 |

OTHER PUBLICATIONS

Burton, Robert Stanley, "Fluid Bed Gasification of Solid Waste Materials," , Problem Report, West Virginia University, (1972).

Alpert, S. B. et al., "Pyrolysis of Solid Waste: A Technical and Economic Assessment,", (Sep. 1972), SRI Project ECC-1886, Stanford Research Inst.

Mechanix Illustrated, Aug. 1979, p. 12, Article beginning "A practical method to burn coal," etc.

*Primary Examiner*—Peter F. Kratz

[57] ABSTRACT

Particulate carbonaceous solids are pyrolytically converted to fuel gas in a fluidized bed containing quartz sand as the primary inert heat-transfer medium. In addition to the quartz sand, the fluidized bed contains an anti-agglomerating composition consisting of a carbonate or oxide of calcium, magnesium, or barium, or mixtures thereof. The formation of sand agglomerates (viz. clinkers) interferring with fluidized bed operation is prevented. Coarsely ground limestone is the preferred additive.

17 Claims, No Drawings

PYROLYTIC CONVERSION OF CARBONACEOUS SOLIDS TO FUEL GAS IN QUARTZ SAND FLUIDIZED BEDS

BACKGROUND AND PRIOR ART

For the pyrolysis or incineration of carbonaceous waste materials in fluidized beds, it is advantageous to employ an inert particulate solid as the medium for transferring heat to the carbonaceous solids. For this purpose, quartz sand has excellent heat capacity and heat transfer properties. See U.S. Pat. Nos. 3,772,999; 3,736,111; 3,776,150; and 3,853,498.

Although both pyrolysis and incineration of carbonaceous wastes can be carried out in fluidized bed reactors containing quartz sand as the heat transfer medium, as indicated by the above-cited patents, the operating conditions of these two processes are quite different. Pyrolysis is carried out under endothermic, reducing conditions, while exothermic, oxidizing conditions are used for incineration. Heretofore, the system was believed to be practical for commercial use only as applied to incineration and not for pyrolysis of carbonaceous wastes to produce a fuel gas. AWT Systems, Inc. of Wilmington, Del., has marketed incineration apparatus under the name "Fluidhearth", which is believed to be similar to that described in U.S. Pat. Nos. 3,772,999 and 3,776,150, assigned to AWT Systems, Inc.

U.S. Pat. No. 3,853,498 describes a system for converting municipal wastes into high energy fuel gas by endothermic pyrolysis. The system uses two sand-containing fluidized beds. In one bed, the sand is heated by an exothermic combustion reaction, and in the other fluidized bed the heated sand is used in the endothermic pyrolysis reaction. Means are provided for transferring the sand between the two beds, and the char produced in the pyrolysis reaction is recycled with the sand for removal in the combustion reaction. There is no known commercial use of such a system.

There has been a major unsolved problem with respect to the use of sand in fluidized beds for pyrolytic conversion of carbonaceous materials to fuel gas. Although the beds are operated at temperatures well below the initial melting temperature of quartz sand (about 1900° F.), after a few hours of operation the sand bed contains agglomerates or "clinkers". Such bed agglomeration or slagging seriously interferes with the fluidization of the bed, necessitating shut-down of the process for removal of the clinkers and replacement of sand. Very little is known about the nature of this agglomeration problem, and prior to the present invention no one has disclosed an adequate solution.

Robert S. Burton studied the conversion of solid wastes to fuel gas in quartz sand fluidized beds. This research is reported in his report submitted for an M.S. degree at the West Virginia University, Morgantown, W.Va., entitled "Fluid Bed Gasification of Solid Waste Materials", dated 1972. The following discussion appears at pages 167–168 of the Burton report:

> "Another problem encountered in the experimental equipment which must be considered in the final process design is the problem of slagging. During the experimental portion of the investigation, it was found that when MSW [municipal solid waste] was fed in a hot reducing atmosphere (1300°–1500° F. at 0.0–0.5 percent oxygen) slag formed. This slag accumulated over the life of the experiment and finally 'choked' the bed ceasing fluidization. The pilot plant facility had no provisions for ash draw off. Also the MSW fed to the fluid bed was merely buried and no attempt was made to remove any ash or inert materials (metals, ceramics, etc.) It appears that the slagging problem centers around the ash in the MSW. In the reducing atmosphere, the ash softening temperature is approximately 300° F. lower than in an oxidizing atmosphere, which brings it into the operating range. Removing the ash and inerts is a step in the right direction but it probably will not completely solve the problem. At best it will only delay 'choking'."

At the request of West Virginia University, the Stanford Research Institute, Menlo Park, Calif., conducted a further study of the pyrolysis process described in the cited Burton thesis. This study included a consideration of the slagging or clinker problem. The results of the study are contained in a report entitled "Pyrolysis of Solid Wastes: A Technical and Economic Assessment", SRI Project ECC-1886, prepared for West Virginia University, September, 1972. Page 45 of the report discusses the problem, stating: "A practical means for preventing the agglomeration of the granular bed material [quartz sand] and of providing for its withdrawal from the reactor are needed". The report then discusses possible solutions relating to the selection of the heat carrier, and/or the continuous removal and replacement of bed material. With reference to the heat transfer medium, the reports states (page 45):

> "Based on the development work performed, the present concept is to use sand in both the pyrolysis and the combustion reactor beds as a heat carrier. Sand does not melt at the proposed operating temperatures, but various alkaline impurities in the refuse may convert the silica to lower melting silicates. It may be desirable to evaluate other materials, such as limestone, dolomite, and petroleum coke."

The above-cited SRI Project report in Appendix C presents an analysis of the clinkers formed in the quartz sand bed. Analysis of samples of the aggregated sand disclosed the presence of two substances which might act as cementing materials. These were bottle glass and various forms of iron oxide. In this connection, the report states (page C-3): "Bottle glass has a softening point above 1100° F. and would become a viscous liquid at the temperature of the reactor."

The foregoing represents the state of the art prior to the present invention, which for the first time makes it practical to employ on a commercial basis a quartz sand fluidized bed for pyrolysis of carbonaceous material to fuel gas. This represents a highly important development because it provides a means for disposing of waste materials, such as municipal garbage, sewage sludge, used tires, etc., and at the same time providing a new and relatively inexpensive source of fuel gas, thereby helping to alleviate the present energy crisis.

SUMMARY OF INVENTION

The present invention is based on the discovery that the problem of sand agglomeration and clinker formation, as described above, can be overcome by incorporating an anti-agglomerating composition in the sand bed for fluidization with the sand and the carbonaceous solids. For example, it was found that the admixture of a minor proportion of ground limestone with the quartz sand prevents agglomerates from forming. The mechanism by which this result is accomplished is not apparent. However, it has been found that other carbonates of alkaline earth metals can be used in the same manner to prevent, or at least minimize the formation of silica agglomerates. More generally, it is believed that agglomeration problems can be alleviated by using with the quartz sand a minor proportion of one or more carbonates or oxides of calcium, magnesium, or barium. The preferred anti-agglomerating material is natural limestone.

DETAILED DESCRIPTION

The pyrolysis reaction is carried out under reducing conditions, that is, the fluidizing gas is oxygen free, or contains less oxygen than required for combustion of the carbonaceous material. The reactions involved are endothermic, requiring heat to be supplied. The fluidized bed reactor may be of the kind which has heretofore been used or proposed for use with sand-containing fluidized beds for pyrolysis of carbonaceous waste materials. See, for example, U.S. Pat. Nos. 3,736,111; 3,772,999; 3,776,150; and 3,853,498. The bottom of the reactor is provided with a diffusion plate for introducing the fluidizing gas, and means are provided, such as a screw conveyor, for introducing the carbonaceous feed material into the bed. Within the reactor, there is maintained the bed of sand containing the anti-agglomerating additive. The fluidizing gas, such as nitrogen, or a mixture of nitrogen, water vapor, and carbon dioxide, may be externally heated to supply the heat required for the reaction. Means may be provided for separately introducing steam or water vapor. The hydropyrolysis of waste materials is preferably carried out in the presence of steam and in a substantially oxygen free atmosphere.

The gaseous product of the reactor, such as a medium BTU fuel gas, is passed from the upper portion of the reactor to a cyclone separator for removal of the entrained ash or char particles. The solids-free product gas may be then sent to a condenser train where the tar, oil and aqueous fractions of the condensables are separated by selective condensation. The resulting dry fuel gas is the principal product.

The residual char which is formed in the process may be removed through a solids overflow from the reactor. The char will be removed with a portion of the sand-additive mixture, and may flow by gravity to a regenerating system. The char may be burned out of the sand mixture, and the mixture returned to the fluidized bed reactor after removing any oversized particles. Alternatively, the separate combustion and pyrolysis units described in U.S. Pat. No. 3,853,498 may be employed. In another method of operation, the fluidized bed pyrolyzer can be operated cyclically, that is, after a period of fuel gas production with the bed being operated under reducing conditions, the production of fuel gas is stopped, and the bed is operated under oxidizing conditions using an excess of oxygen to burn out the residual char while at the same time liberating heat and additional particles of mineral ash, which are removed with the combustion gases.

For the purpose of the present invention, the primary heat transfer medium of the fluidized bed is quartz sand. For example, beach sand having an average size from about 0.5 to 2.0 millimeters diameter may be used. The quartz sand preferably comprises 55% or more by weight of the mixed bed (sand and additive). The additive of anti-agglomerating composition can be a carbonate or oxide of calcium, magnesium, or barium, or mixtures of such carbonates or oxides. To be effective, the additive must be retained in the fluidized bed, or additional quantities must be added. The action of the quartz sand in the fluidized bed tends to progressively reduce the particle size of the anti-agglomerating additive by a grinding or attrition action. As part of the additive reaches a very fine state of sub-division, it will be removed by entrainment in the fluidizing gas along with other very fine solid particles, including particles of sand, char, and mineral ash. Therefore, to minimize the attrition loss of the additive, it is preferred to incorporate the additive as a relatively large particle size material, and to employ a form of the additive which is relatively hard and durable. For example, lime and chalk are less desirable forms of the additive than calcium carbonate in the form of limestone or marble. As used herein, the term "limestone" refers to the natural mineral composed substantially of calcium carbonate, or the dolomite mineral, which contains both calcium and magnesium carbonates ($CaCO_3.MgCO_3$). Barium carbonate can be used in its witherite mineral form. At the temperatures usually employed for the pyrolysis reaction, such as 1350 to 1450° F., calcium and barium carbonates are stable, but magnesium carbonate will decompose to the oxide. While such decomposition in itself does not appear to interfere with the desired anti-agglomerating action, it may contribute to the particle size reduction and therefore increase the loss of the additive with the gas product. Therefore, calcium carbonate or barium carbonate minerals are preferred. Rather than dolomitic limestone, ordinary limestone composed substantially entirely of calcium carbonate is the most desirable. Excellent results can also be achieved with calcium carbonate in the form of marble, but this material is less available and more expensive than limestone.

The anti-agglomerating composition is added in a particulate form for fluidization with the sand and the carbonaceous solids. The degree of sub-division of the additive can be comparable to or greater than that of quartz sand. Preferably, the additive has an average particle size at the beginning of its use of at least 0.5 milliliters. For example, an average particle size of from about 1 to 2 milliliters is advantageous. However, the additive may be used in larger or smaller particle sizes, providing the particle size is large enough to be retained in the bed and not so large that the particles cannot be fluidized in the bed.

The proportions of sand to additive are not critical, providing there is sufficient amount of the additive present to prevent the agglomeration of the sand. The additive will usually be present in excess. Amounts of the additive in the range of from 1 to 45% by weight can be used based on the combined weight of the sand and the additive. A preferred range is believed to be from 5 to 35% of the anti-agglomerating composition. In other words, from 5 to 35 parts by weight of the additive will be combined with from 95 to 65 parts of the sand to obtain a bed containing from 95 to 65% quartz sand together with from 5 to 35% of said anti-agglomerating composition. Within these stated ranges, it does not appear that differences in the densities or molecular weights of particular additives need be taken into account.

In general, the fluidized beds as prepared in accordance with the present invention are operated at temperatures sufficient to convert the carbonaceous solids to the desired fuel gas product. The maximum temperature must be well below the temperature at which the grains of sand begin to agglomerate due to sintering of the sand grains by softening or initial melting of the silica. It has been reported that quartz sand has a fusion temperature of about 1900° F. (1037° C.). More desirably, the temperature is kept below 1500° F. (815° C.), such as a temperature in the range from 1350°–1450° F. (738°–788° C.).

A wide variety of carbonaceous solids can be processed. These include municipal garbage (viz. food and paper wastes), animal manure, such as feedlot manure, and agricultural residues, such as wheat straw or cornstalks. Other cellulosic waste materials can be used, such as sawdust. Sewage sludge resulting from municipal sewage treating plants can also be processed in either granular or pelletized form. Rubber tires may be shredded or otherwise subdivided and used, either alone or in combination with other materials, such as municipal garbage. Similarly where desired, ground coal can be used, preferably in combination with a waste material such as municipal garbage, animal manure, cellulosic plant residues, or sewage sludge. Such carbonaceous materials contain mineral salts, which are non-combustible and form ash. It appears that such ash may promote the agglomeration of the sand particles, but this is substantially prevented by the action of the anti-agglomerating additive.

One of the additional advantages of the improved heat treating beds of the present invention is that they are more stable in use, and adapt themselves to wide variations in the feed materials. For example, the pyrolysis process may be operated with varying feeds, or with mixtures of feed materials. In certain embodiments, from 25 to 100% by weight of the feed material will comprise animal manure, cellulosic plant residues, sewage sludge, or rubber tires. In other embodiments, from 25 to 75 parts by weight of animal manure, cellulosic plant residues, or sewage sludge, may be used in admixture with 25 to 75 parts of tires or coal. In one preferred application, the feed is composed substantially of a mixture of tires and municipal garbage. Many more combinations can be used, and it will be understood that those given are illustrative of the kinds of feed materials which can be advantageously processed in the improved beds with minimal agglomeration of the sand, as compared with the agglomeration that would occur in the absence of the additive.

Where the fluidized bed is being operated to produce a fuel gas, the available data indicates that more combustible gas is produced by the sand beds containing the anti-agglomerating composition. The explanation for this effect is not fully understood, although maintaining the bed in fully fluidized condition should help to promote the desired reactions. This effect and other advantages of the invention are illustrated by the following specific examples.

EXAMPLE I

A bench scale fluid bed reactor was used to examine the influence of bed additives on reactor performance during pyrolytic operation. The reactor was constructed from a 2-inch diameter by 20 inch length Inconel pipe which was fitted with a 4-inch diameter by 6-inch length of the same to serve as a disengaging zone. The lower section of the reactor served as a fluidizing gas distributor and gas preheater. Nominal static bed height was 3 inches. The bed was composed of 30–50 mesh particles of either silica sand or a 25% by weight mixture of limestone in silica sand. Heat was supplied to the reactor by means of semi-cylindrical electrical resistance heaters which jacketed the reactor. Steam was used as the fluidizing gas at a superficial velocity of 1.2 ft/sec.

Dried feedlot manure (10–40 mesh) was used as the pyrolysis test material. It was fed to the reactor continuously through a concentric tube which discharged just above the expanded bed surface. Typical runs consisted of feeding at the desired temperature for about one hour followed by combustion of the char that was retained in the bed. Tests were conducted with sand and sand-limestone beds over a temperature range of 1250° to 2000° F. Table A presents a comparison of gas heating value which shows that the heating value of the gas does not change appreciably by the addition of limestone to the bed. Table B presents a comparison of the gas yield which shows a significantly higher yield when limestone is present in the bed. When sand alone was used as the bed material, serious agglomeration was observed within 15 to 35 minutes after the initiation of feeding. When limestone (25% by weight) was an additive to the bed, no agglomeration was observed after 7.3 hours of cumulative operating time under reducing conditions. The bed was removed after this time even though it was operating satisfactorily.

TABLE A

Gas Heating Value Versus Reactor Temperature

| Temperature °F. | Heating value (Btu/SCF) without limestone | Heating value (Btu/SCF) with limestone |
|---|---|---|
| 1300 | 290 | 302 |
| 1400 | 352 | 350 |
| 1500 | 390 | 340 |
| 1600 | 408 | 348 |
| 1700 | 410 | 330 |
| 1800 | 397 | 335 |
| 1900 | 373 | 348 |

TABLE B

Gas Yield Versus Reactor Temperature

| Temperature °F. | Yield (SCF/lb) without limestone | Yield (SCF/lb) with limestone |
|---|---|---|
| 1300 | 8.8 | 11.9 |
| 1400 | 10.6 | 14.1 |
| 1500 | 12.3 | 16.3 |
| 1600 | 14.1 | 18.4 |
| 1700 | 15.8 | 20.6 |
| 1800 | 17.5 | 22.7 |
| 1900 | 19.2 | 25.0 |

EXAMPLE II

The bench scale reactor of Example I was also used to test other bed additives using feedlot manure as the gasification feedstock. The sand and additive particles were composed of 30–50 mesh particles with the additive present as 25% by weight of the mixture. These tests were conducted with steam as the fluidizing gas at a temperature of 1400° F. The gas superficial velocity was 1.2 ft/sec. With marble chip as the additive, the bed was operated for 2.2 hours without agglomeration. It was then removed to test another additive. With dolomitic limestone as the additive, the bed maintained smooth operation for 3.3 hours. No agglomeration was evident at the end of this period.

EXAMPLE III

Gasification tests were conducted in a pilot scale fluid-bed reactor. The reactor was 9" ID×34" with an expanded freeboard section of 16" ID×34". A perforated plate was used as the gas distributor. Hot fluidizing gas was generated by the combustion of propane under starving air conditions with the simultaneous injection of water into the combustion zone. The feed material to be gasified was introduced to the reactor through a vertical feed pipe which discharged just above the bed surface. A screw feeder was used to deliver the feed to the feed pipe from the storage hopper. Reactor off-gas including condensables and elutriated solids were withdrawn from the top of the reactor and passed to a high temperature cyclone for removal of solids. The solids free gas was then passed to a venturi scrubber which quenched the gas and removed the condensables. The gas was then incinerated prior to venting to the atmosphere.

The bed was normally composed of 100 lb of solids (sand and limestone). The bed composition was 15 lb limestone (3–10 mesh) and 85 lb quartz sand (14–50 mesh). In the conduct of a test run, the bed was heated to the desired temperature by the hot fluidizing gas and supplemental heating via a radiant fired jacket around the lower section of the bed. Continuous feeding was then initiated and samples of the fluidizing gas and reactor off-gas were taken for analysis. At the end of the run, additional air was added to the fluidizing gas stream in order to burn off the char which was held up in the bed. After char combustion, the remaining ash was readily elutriated from the bed. The reactor was operated at temperatures between 1150° F. and 1450° F. with superficial velocities of the fluidizing gas ranging between 1.0 and 1.5 ft/sec. The produced gas was determined by difference between the reactor off-gas and the fluidizing gas with the aid of a nitrogen balance. Gas compositions were determined by gas phase chromatography.

Table C summarizes results obtained with four different feed materials, manure, sewage sludge, cane and tires. All of these materials contained less than 10% moisture. Table C presents the heating value of the produced gas as calculated from the produced gas analysis and the yield of produced gas on the basis of one pound of dry ash free feed.

Two beds with limestone additive were used in the collection of these data. One bed was discarded due to sand attrition after 100 hours of operation. The other has accumulated 50 hours of operation. Neither bed showed signs of serious agglomeration. A test was also conducted without limestone additive using cane as the feed material. This bed operated for 1.5 hours, after which serious agglomeration was encountered.

We claim:

1. The method of pyrolytically converting subdivided carbonaceous solids to a fuel gas in a fluidized bed containing quartz sand as the primary inert medium for transferring heat to said carbonaceous solids, said bed being operated under endothermic reducing conditions at a temperature sufficient to convert said solids but below the sintering temperature of said sand, wherein the improvement comprises forming said bed from a mixture of said quartz sand and an anti-agglomerating composition in particulate form for fluidization with said sand and said carbonaceous solids, at least 55% by weight of said bed being said quartz sand, said anti-agglomerating composition being selected from the class consisting of the carbonates and oxides of calcium, magnesium, and barium, and mixtures thereof, said bed containing from 1 to 45% by weight of said anti-agglomerating composition based on the combined weight of said sand and said composition, said bed being operated as a fluidized bed without the formation of aggregates which interfere with the bed fluidization while producing a fuel gas in said bed.

2. The method of claim 1 in which said bed contains from 5 to 35% of said anti-agglomerating composition based on the combined weight of said sand and said composition.

3. The method of claim 1 or claim 2 in which said anti-agglomerating composition is selected from the class consisting of (a) limestone composed substantially of $CaCO_3$, (b) dolomitic limestone, and (c) marble.

4. The method of claim 1 or claim 2 in which said anti-agglomerating composition comprises a ground limestone having an average particle size of at least 0.5 millimeters.

5. The method of claim 4 in which said carbonaceous solids are selected from the class consisting of municipal and industrial refuse, animal manure, cellulosic plant residues, sewage sludge, rubber tires, and mixtures thereof, said solids being in sufficiently finely-divided condition to facilitate fluidization thereof.

6. The method of pyrolytically converting particulate carbonaceous solids to a fuel gas in an atmosphere containing steam while being substantially free of oxygen, said conversion being carried out under endothermic reducing conditions in a fluidized bed containing quartz sand as the primary inert medium for transferring heat to said carbonaceous solids, said bed being operated at a temperature sufficient to convert said solids but below the sintering temperature of said sand, wherein the improvement comprises forming said bed from a mixture consisting of said quartz sand and an anti-agglomerating composition being selected from the class consisting of the carbonates of calcium, magnesium, and barium, and mixtures thereof, said bed containing from 5 to 35% by weight of said anti-agglomerating composition together

TABLE C

| Temperature °F. | Produced Gas Obtained With the Pilot Scale Reactor | | | | | | | |
|---|---|---|---|---|---|---|---|---|
| | Manure | | Sewage Sludge | | Cane | | Tires | |
| | Heating Value Btu/SCF | Yield SCF/lb | Heating Value Btu/SCF | Yield SCF/lb | Heating Value Btu/SCF | Yield SCF/lb | Heating Value Btu/SCF | Yield SCF/lb |
| 1150 | 475 | 8.2 | — | — | — | — | 1080 | 3.3 |
| 1200 | 501 | 9.8 | — | — | 351 | 9.2 | 1000 | 4.0 |
| 1250 | 510 | 10.9 | — | — | 368 | 12.7 | 915 | 5.0 |
| 1300 | 507 | 11.7 | 520 | 8.4 | 365 | 16.2 | 835 | 6.4 |
| 1350 | 489 | 12.3 | 510 | 8.2 | 343 | 19.6 | 755 | 8.1 |
| 1400 | 458 | 12.7 | 505 | 8.0 | — | — | 675 | 10.0 |
| 1450 | — | — | 500 | 7.8 | — | — | 595 | 12.0 |

with from 95 to 65% of said quartz sand, said bed being operated as a fluidized bed without the formation of aggregates which interfere with the bed fluidization while producing a fuel gas in said bed.

7. The method of claim 6 in which said anti-agglomerating composition is selected from the class consisting of (a) limestone composed substantially of $CaCO_3$, (b) dolomitic limestone, and (c) marble.

8. The method of claim 6 in which said anti-agglomerating composition comprises a ground limestone having an average particle size of at least 0.5 millimeters.

9. The method of claim 1 or claim 6 in which said carbonaceous solids are composed of from 25 to 100% by weight of municipal and industrial refuse.

10. The method of claim 1 or claim 6 in which said carbonaceous solids are composed of from 25 to 100% by weight of rubber tire material.

11. The method of claim 1 or claim 6 in which said particulate carbonaceous solids are composed of from 25 to 100% by weight of cellulosic plant residue material.

12. The method of claim 1 or claim 6 in which said carbonaceous solids are composed of from 25 to 100% by weight of sewage sludge material.

13. The method of claim 1 or claim 6 in which said carbonaceous solids are composed substantially of a mixture of rubber tire material and municipal and industrial refuse.

14. The method of claim 1 or claim 6 in which said particulate carbonaceous solids comprise from 25 to 75 parts by weight of animal manure in admixture with from 25 to 75 parts by weight of at least one other carbonaceous material selected from the class consisting of tires and coal.

15. The method of claim 1 or claim 6 in which said carbonaceous solids comprise from 25 to 75 parts by weight of cellulosic plant residues in admixture with from 25 to 75 parts by weight of at least one other carbonaceous material selected from the class consisting of tires and coal.

16. The method of claim 1 or claim 6 in which said carbonaceous solids comprise from 25 to 75 parts by weight of sewage sludge in admixture with from 25 to 75 parts by weight of at least one other carbonaceous material selected from the class consisting of tires and coal.

17. The method of claim 1 or claim 6 in which said carbonaceous solids comprise from 25 to 75 parts by weight of rubber tires in admixture with from 25 to 75 parts by weight of coal.

* * * * *